US006573831B2

(12) United States Patent
Ikeda et al.

(10) Patent No.: US 6,573,831 B2
(45) Date of Patent: Jun. 3, 2003

(54) STATUS NOTIFICATION SYSTEM, STATUS NOTIFICATION APPARATUS, AND RESPONSE APPARATUS

(75) Inventors: Kiyokazu Ikeda, Kanagawa (JP); Yoshiyuki Kamon, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/891,842

(22) Filed: Jun. 26, 2001

(65) Prior Publication Data

US 2002/0041240 A1 Apr. 11, 2002

(30) Foreign Application Priority Data

Jun. 29, 2000 (JP) ..... 2000-201463

(51) Int. Cl.[7] ..... G08B 26/00

(52) U.S. Cl. ..... 340/505; 340/518; 340/521; 340/531; 340/539; 340/825.51

(58) Field of Search ..... 340/505, 521, 340/518, 531, 825.51, 539; 455/517; 128/903; 700/9

(56) References Cited

U.S. PATENT DOCUMENTS

| | | | | |
|---|---|---|---|---|
| 3,921,168 A | * | 11/1975 | Dunbar | 340/518 |
| 4,065,644 A | * | 12/1977 | Shinosky | 379/260 |
| 4,295,121 A | * | 10/1981 | Enser et al. | 382/177 |
| 4,302,746 A | * | 11/1981 | Scarzello et al. | 340/938 |
| 4,335,413 A | * | 6/1982 | Engel et al. | 361/93.2 |
| 4,365,238 A | * | 12/1982 | Kollin | 340/521 |
| 4,392,206 A | * | 7/1983 | Neathway et al. | 379/284 |
| 4,423,408 A | * | 12/1983 | Place | 341/167 |
| 5,023,831 A | * | 6/1991 | Bonke et al. | 710/16 |
| 5,850,519 A | * | 12/1998 | Vazana | 709/206 |

* cited by examiner

*Primary Examiner*—Daryl Pope
(74) *Attorney, Agent, or Firm*—Jay H. Maioli

(57) ABSTRACT

A system to detect a status of a movable body having a status notification system from information supplied by a plurality of sensors installed on the movable body selectively transmits sensor information to a response apparatus connected to another network in a wireless manner based upon a result of the detection, and when the response apparatus requests additional sensor information, the status notification system transmits the stored sensor information selectively, thereby executing only the communication necessary for movable body rescue and support activities.

31 Claims, 7 Drawing Sheets

| | | |
|---|---|---|
| 1 | USER INFORMATION | NAVIGATOR ID (PHONE NUMBER) |
| 2 | | |
| 3 | | |
| | | |

STATUS NOTIFICATION SYSTEM, STATUS NOTIFICATION APPARATUS, AND RESPONSE APPARATUS

BACKGROUND OF THE INVENTION

The present invention relates generally to a status notification system for determining, on the basis of sensing information selectively supplied wirelessly from a status notification apparatus which transmits a movable body status sensed at a movable body, the movable body status and determining whether to request the transmission of additional sensing information by a response apparatus.

Today, automobile insurance companies not only sell automobile insurance policies but also offer various kinds of car-associated services to insurance policy purchasers for charge or free of charge, thereby enhancing the added values of automobile insurance. To be specific, if a car covered by insurance is involved in an accident or has a breakdown, the insurance company rushes to the scene to take necessary actions such as wrecking or arranging lodgings for the driver in the case where traveling by car becomes impossible, for example.

The offering of the above-mentioned services is basically initiated by the notification by telephone for example from the driver in trouble such as an accident or a breakdown. This means that the notification is totally depends on the discretion of the driver. Therefore, in some situations, the driver may not correctly tell the details of the trouble he is in, thereby making it impossible for the insurance company to take proper rescue or support actions.

SUMMARY OF THE INVENTION

It is therefore an object of the present invention to provide a status notification system, a status notification apparatus, and a response apparatus for providing appropriate rescue and support services to automobile insurance purchasers.

In carrying out the invention and according to one aspect thereof, there is provided a situation notification system for automatically wirelessly communicating, on the basis of information supplied from a plurality of sensors installed on a movable body, a status of the movable body through a response unit and a communication unit connected to a network, having a status sensing unit for transmitting, if the movable body is found in a predetermined situation on the basis of data obtained from the plurality of sensors installed on necessary portions of the movable body, predetermined data to the response unit through the communication unit and selectively transmitting, if an additional information transmission request is received from the response unit through the communication unit, the data obtained from the plurality of sensors, a communication unit for wirelessly communicating with the status sensing unit and communicating with the response unit and a response unit for receiving the predetermined data from the status sensing unit through the communication unit, determining whether the acquisition of the additional information is necessary on the basis of the predetermined data, and, if the acquisition of the additional information is necessary, requesting, through the communication unit, the status sensing unit for the transmission of the additional information, the status sensing unit including an input means for inputting sensing information sensed from the plurality of sensors, a storage means for storing the sensing information inputted by the input means, a sensing means for sensing whether the sensing information is within a predetermined range, a communication means for wirelessly communicating with the response unit and a control means, if the movable body having the status sensing unit is found by the sensing means that the movable body is in a predetermined status, for selecting predetermined sensing information from the sensing information stored in the storage means, controlling the communication means so as to wirelessly transmit the selected sensing information to the response unit, and, if the request for the acquisition of the additional information is subsequently received from the response unit, reading the requested additional information from the storage means to transmit the read additional information, the communication unit including a wireless communication means for wirelessly communicating with the status sensing unit, a network communication means for communicating with the response unit connected to the network and a conversion means for converting a data format of the wireless communication and a data format of the network communication and the response unit including a communication means for communicating with the status sensing unit through the network, an evaluation means for evaluating a status of the movable body having the status sensing unit from the predetermined sensing information supplied from the status sensing unit and a control means, if the request for the additional information is found necessary on the basis of an evaluation result obtained by the evaluation means, for controlling the communication means so as to transmit acquisition request information for requesting the additional information to the status sensing unit.

In carrying out the invention and according to another aspect thereof, there is provided a status notification apparatus for automatically wirelessly communicating with a response unit connected to a network a status sensed on a movable body through a commutation unit for wireless communicating data with the network, including an input means for inputting sensing information sensed from the plurality of sensors, a storage means for storing the sensing information inputted by the input means, a sensing means for sensing whether the sensing information is within a predetermined range, a communication means for wirelessly communicating with the response unit and a control means, if the sensing information is found within the predetermined range by the sensing means, for selecting predetermined sensing information from the plurality of pieces of sensing information inputted from the plurality of sensors, controlling the communication means so as to transmit the selected sensing information to the response unit as initial information and, if an additional information request signal is received from the response unit, controlling the communication means so as to selectively read the requested sensing information from the storage means to transmit the read sensing information to the response unit.

In carrying out the invention and according to still another aspect thereof, there is provided a response apparatus for communicating, via a network, with a status notification apparatus which selectively transmits information supplied from a plurality of sensors installed on a movable body by wirelessly communicating with a communication unit, including a communication means for network-communicating with the communication unit an evaluation means for evaluating predetermined sensing data selectively supplied from the status notification apparatus and a control means, if the reception of further sensor information from the status notification apparatus is found necessary on the basis of a result of the evaluation made by the evaluation means, for controlling the communication means so as to transmit to the status notification apparatus an additional information transmission request signal for requesting the transmission of additional sensor information.

BRIEF DESCRIPTION OF THE DRAWINGS

These and other objects of the invention will be seen by reference to the description, taken in connection with the accompanying drawing, in which.

DETAILED DESCRIPTION OF PREFERRED EMBODIMENTS

Figure 1:
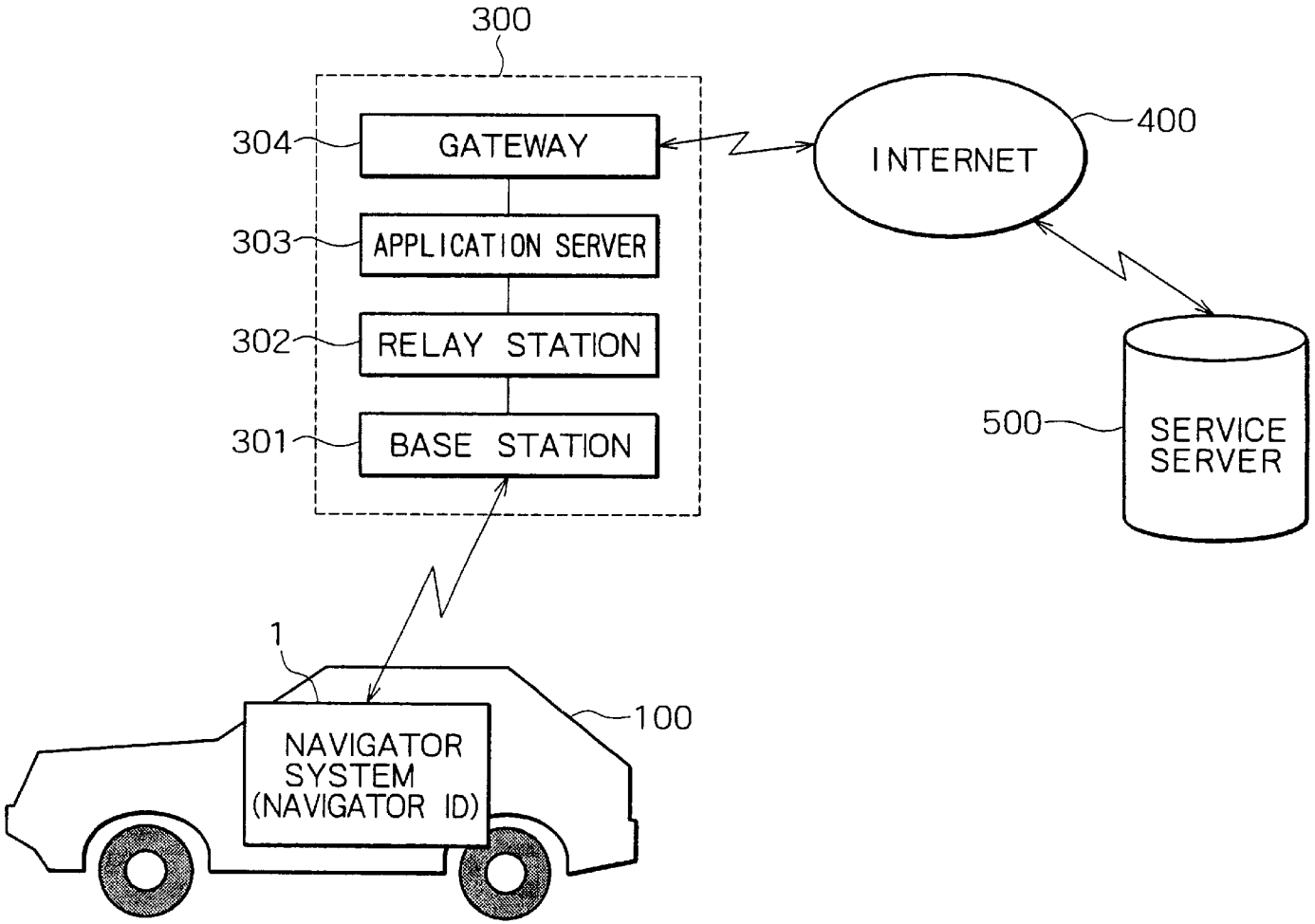
FIG. 1 is a schematic diagram illustrating an overall configuration of a security system practiced as one embodiment of the invention.

A movable body security system and on-vehicle security device practiced as some embodiments of the present invention will be described in further detail by way of example with reference to the accompanying drawings in the following sequence:

1. Security system
   1-1 Overall configuration
   1-2 Overall configuration of the navigator system
   1-3 Internal configuration of the navigator main frame
   1-4 Internal configuration of the application server
   1-5 Internal configuration of the service server
2. Exemplary service provision by the security system
3. Processing operations 1. Security System 1-1 Overall Configuration Now, referring to FIG. 1, there is shown a security system practiced as one embodiment of the present invention. An automobile 100 carries a navigator system 1. This navigator system, based on a so-called car navigator, includes a security system for preventing car theft for example and a communication terminal device capable of data communication through a wireless telephone communication network 300. The owner of the automobile 100, or the user of the navigator system 1, receives the provision of services from this security system.

The wireless telephone communication network 300 realizes mobile communication between wireless terminal devices such as mobile telephones, not shown. In the present embodiment, the wireless telephone communication network 300 is compatible with the mobile communication by the wireless terminal device of a car navigator. The wireless telephone communication network 300 has a base station 301, a relay station 302, an application server 303, and a gateway 304 as shown. The base station 301 and the relay station 302 support the wireless communication between wireless terminal devices for example. When a wireless terminal device is connected to the Internet, the application server 303 carries out the job of the connection. The application server 303 is adapted to execute the processing required for the Internet capabilities provided by that wireless communication company for example. Converting the data processed by the application server 303 through a gateway 304 allows the wireless terminal device connected to the wireless telephone communication network 300 to be eventually connected to the Internet 400.

Various servers are connected to the Internet. In the present embodiment, a service server 500 is connected to the Internet as shown in FIG. 1. The service server 500 is configured to provide capabilities for providing the security services to the automobile 100 installed with the navigator system 1 purchased by the user and the driver and a passenger or passengers for example of the automobile 100.

It is assumed that the navigator system 1, a tangible product, of the present embodiment be purchased in combination of an automobile insurance policy, an intangible product. It is also assumed that the combined purchase of the navigator system 1 and the automobile insurance policy be made by use of the Internet, so-called Internet shopping. The service server 500 is managed by an automobile insurance company alone or jointly by an automobile insurance company and a sales company of the navigator system 1 or its maker. Directly, the service server 500 is associated with the management of automobile insurance.

Given such a configuration, the navigator system 1 having a communication terminal capable of wireless telephone communication is connected to the Internet 400 via the wireless telephone communication network 300 to carry out communication with the service server 500.

1-2 Overall Configuration of the Navigator System

Figure 2:
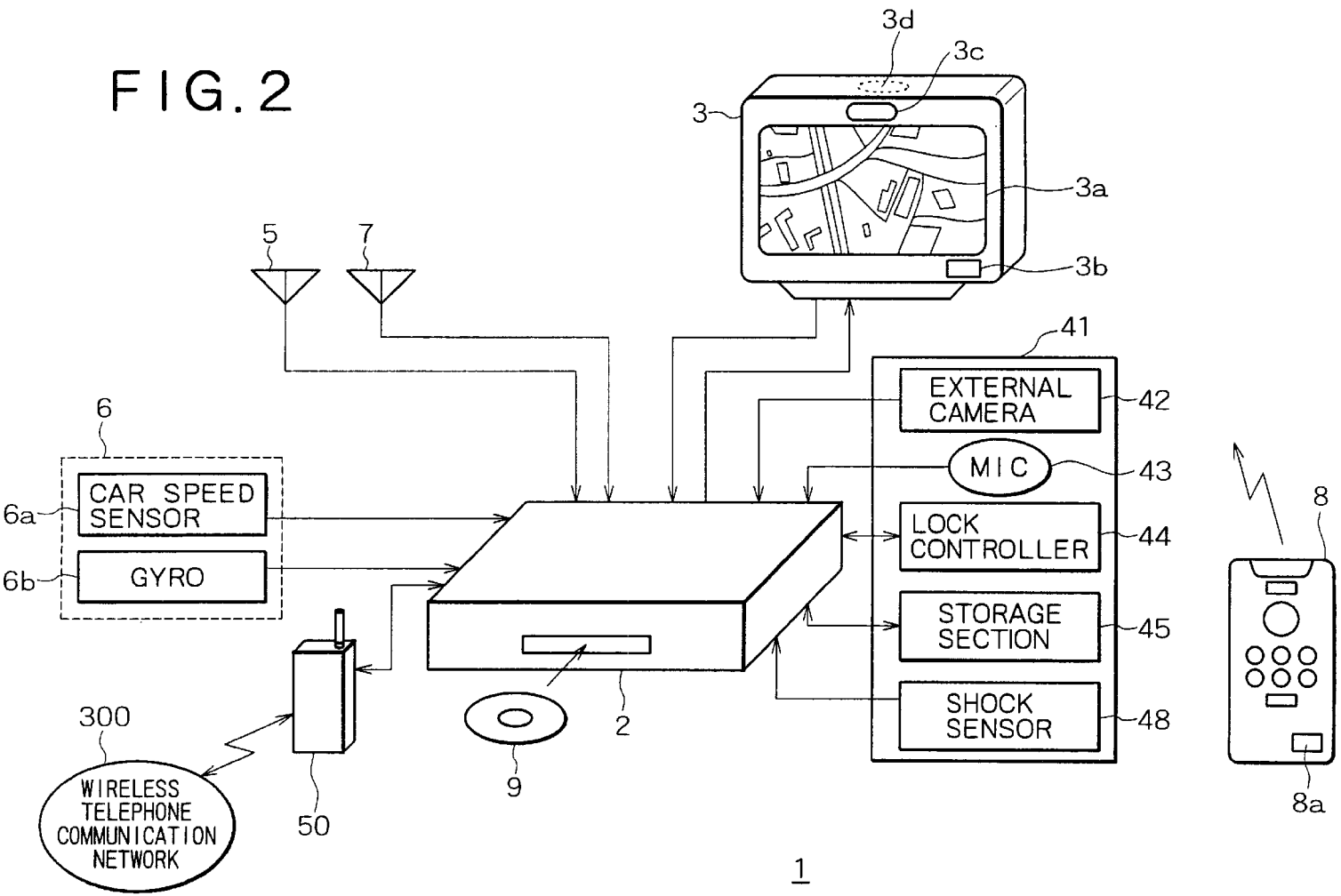
FIG. 2 is a schematic diagram illustrating an exemplary configuration of a navigator system of FIG. 1.

Referring to FIG. 2, there is schematically shown an overall configuration of the navigator system of the present embodiment. The navigator system 1 includes a navigator main frame 2, a display monitor 3, a GPS (Global Positioning System) antenna 5, a traffic information receiving antenna 7, an autonomous navigation unit 6, a communication terminal unit 50, a security system 41, and a remote controller 8.

The details of the configuration of the navigator main frame 2 will be described later. On the basis of the map information read from a recording medium 9 and current positional information, the navigator main frame 2 displays the current position of the automobile on a map shown on a display screen section 3*a* of the display monitor 3 for example and displays navigation information such as drive routes and various drive guides.

The recording medium 9, which is a CD-ROM (Compact Disk Read Only Memory) or a DVD-ROM (Digital Video Disk or Digital Versatile Disk Read Only Memory) for example, stores the map information as described above.

The display screen section 3*a* of the display monitor 3, which is a LCD (Liquid Crystal Display) device for example, displays image information supplied from the navigator main frame 2. A receiver 3*b* receives the command information from the remote controller 8. The received information is transferred to the navigator main frame 2 as described later.

Although not shown, an audio output section, such as a speaker, is installed on the navigator apparatus of the present embodiment. An alarm sound or a guide voice can be outputted from the audio output section on the basis of audio navigation information such as intersection points, traffic congestion status, turning points, and route errors.

The GPS antenna 5 receives radio waves from a GPS satellite for example. The radio waves received by the GPS antenna 5 are demodulated as received data to be captured in the navigator main frame 2 for use for obtaining automobile's current location, which will be described later.

The traffic information antenna 7 receives road traffic information which is transmitted by FM multiplexer, optical beacon, or radio beacon under a predetermined road traffic information communication system. The received road traffic information includes a road congestion status and parking lots for example. On the basis of this road traffic information, the navigator main frame 2 can display such information as road congestion, time required to reach destination based on congestion status, and parking lot guide.

The autonomous navigation unit 6 detects travel information such as the travel speed and direction of the automobile. As shown in FIG. 2, the autonomous navigation unit 6 has a car speed sensor 6*a* for detecting a car speed pulse signal which varies in accordance with travel speed and a gyro 6*b* which detects travel directions. The travel information detected by the autonomous navigation unit 6 is also sent to the navigator main frame 2 for use for determining automobile's current location. Especially, the autonomous navigation unit 6 is used to determine automobile's current location when the automobile is running in a tunnel or underground and therefore cannot receive satellite communication radio by the GPS antenna 5.

The remote controller 8, for use by the user of the navigator system 1 of the present embodiment when operating the same, has various operator keys, a signal generator for generating command signals in accordance with the operations done by the user, and an output section for outputting command signals as infrared luminance modulating signal. The command output based on this infrared light is received by the above-mentioned receiver 3*b*. An emergency key 8*a* of the remote controller 8 is operated by the user when the automobile gets in a dangerous situation such as a traffic accident or troubles with the other party. When the emergency key 8*a* is operated, the user can receive appropriate security services from a security server to be described later.

It should be note that the operating means may be a remote controller based on radio, a remote controller wired to the navigator main frame 2, or an operator unit mounted on the navigator main frame 2 or the display monitor 3.

The communication terminal unit 50 is a mobile communication terminal which connects this system to the Internet via the wireless telephone communication network 300 shown in FIG. 1. The communication terminal unit 50, when connected to the navigator main frame 2 as shown, can send data from the navigator main frame 2 in a wireless manner and input received data into the navigator main frame 2 for predetermined processing. Namely, the connection of the communication terminal unit 50 with the navigator main frame 2 provides at least the Internet connection capability to the navigator system 1 of the present embodiment.

The security system 41 has capabilities of securing the automobile itself and its driver and a passenger or passengers. In this embodiment, the security system 41 has an external camera 42, a microphone 43, a lock controller 44, a storage section 45, and a shock sensor 48. The external camera 42 is actually constituted by a plurality of camera devices, however these devices are shown as one functional block for the sake of an explanation. These camera devices as the external camera 42 are mounted at predetermined positions inside or outside the automobile in predetermined directions according to the purpose. Consequently, the situation inside and around the automobile can be imaged.

For the same purpose, a in-car camera 3*c* and a front camera 3*d* are disposed on the display monitor section 3. The in-car camera 3*c* is disposed on the display screen section 3*a* side of the display monitor 3 and the front camera 3*d* on the opposite side to image the front direction of the automobile. The display monitor 3 is disposed between the front glass of the automobile and the driver such that it does not block the driver's front view. This disposition of the display monitor 3 allows the in-car camera 3*c* to image the interior of the automobile and the front camera 3*d* to image the front view of the automobile. In consideration of a combination use of the in-car camera 3*c*, the front camera 3*d*, and the external camera 42, a plurality of external cameras 42 may be installed on the automobile so that they can image the rear view and the right and left views. The image signals from these camera devices are inputted in the navigator main frame 2 to be stored in the storage section 45 as moving image data as will be described later. For the imaging element of these camera devices, the CCD (Charge Coupled Device) may be used for example.

The microphone 43 is installed on the automobile so as to pick up audio outside the automobile. The collected audio are inputted into the navigator main frame 2 as audio signals to be stored in the storage section 45 as audio data which will be describe later.

The lock controller 44 is installed on the automobile such that the open/close operation of the automobile key can be controlled. Also, in accordance with the key's open/close operation, the lock status information indicative of whether or not the key is locked can be outputted to the navigator main frame 2.

The storage section 45 is constituted by a storage device for storing data of comparatively large size. The storage medium for use as the storage section 45 is not limited to any particular medium. It may be a hard disk, or another disk medium, or a non-volatile memory element for example. In the present embodiment, the storage section 45 stores the moving image data supplied from the camera devices and the audio signal data supplied from the microphone 43 as evidence information for use in reproducing situations inside and around the automobile.

The shock sensor 48 is installed on a predetermined position of the automobile 100 to detect a shock for example applied to the automobile. A plurality of shock sensors 48 may be installed on predetermined positions on the automobile 100 to properly detect shocks applied to various portions of the automobile 100. The shock information detected by the shock sensor 48 is transmitted to the navigator main frame 2 to be captured by the controller 19.

1-3 Internal Configuration of the Navigator Main Frame

Figure 3:
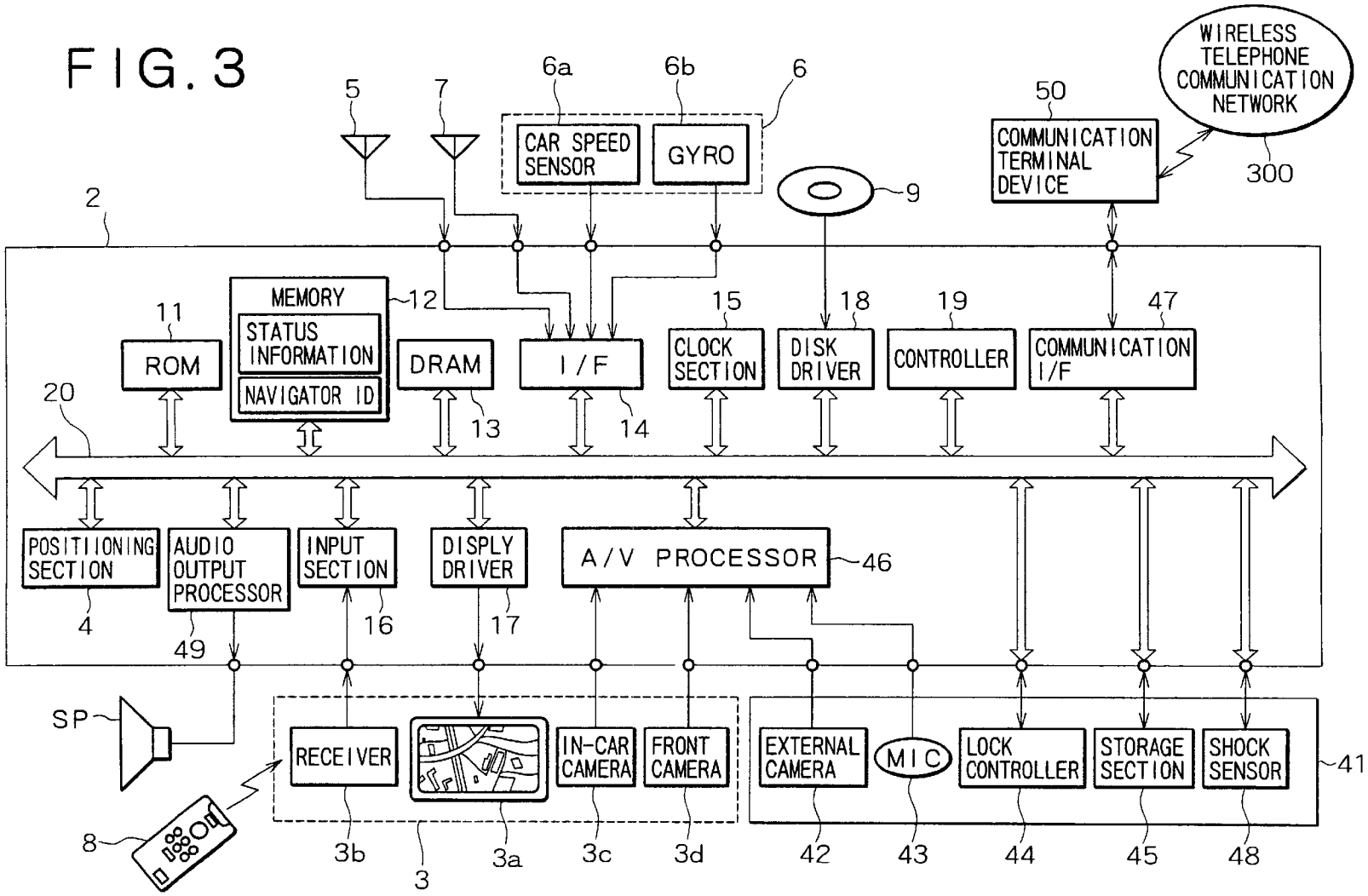
FIG. 3 is a block diagram illustrating an exemplary internal configuration of the navigator system of FIG. 2.

Referring to FIG. 3, there is shown a block diagram illustrating an exemplary internal configuration of the navigator main frame 2. As shown, a positioning section 4 determines the current location of the automobile. The positioning section 4 executes a predetermined computational operation by use of the GPS receive data and the automobile's travel information transferred from an interface 14 to provide longitude/latitude information as the positional information indicative of the current location of the automobile.

A ROM (Read Only Memory) 11 stores various programs for the navigator system 1 to execute predetermined processes and, in general, various non-rewritable factory preset data. A memory 12 is an EEPROM (Electrically Erasable and Programmable Read Only Memory) including a flash memory for example which retains its content when the power to it is off, thereby storing so-called backup data. The backup data includes user-specified destinations and routes thereto for example and various other information. Use of a rewritable memory element such as non-volatile memory or flash memory for the ROM 11 enables the rewrite or update programs and factory preset data as required. In the present embodiment, the ROM 11 is also rewritable.

In the present embodiment, the memory 12 stores the navigator ID unique to the navigator system 1. This navigator ID is allocated at the user registration made when the user decides the purchase of the navigator system and written to the memory 12 before the navigator system is delivered to the user. Alternatively, the navigator ID may be written to the memory 12 after the purchase by connecting the navigator system 1 to the Internet and executing so-called online user registration, the navigator ID being allocated from the service server 500.

In the present embodiment, the memory 12 may also store status information. This status information indicates a status of the automobile 100 which is required by the service server 500 for carrying out security services. The contents of status information will be described later.

A DRAM (Dynamic Random Access Memory) 13 provides a work area in which the controller 19 executes various processes. Also, the processing for generating navigation image information on the basis of the map information for example reproduced from the recording medium 9 by a disk driver 18 is executed by use of the DRAM 13.

An interface (I/F) 14 connects the navigator main frame 2 to an external unit. The interface 14 in this example receives the data from the GPS antenna 5. Also the data of the road traffic information supplied from the traffic information antenna 7 is inputted to the interface 14. The interface 14 also receives the car speed pulse detected by the car speed sensor 6*a* of the autonomous navigation unit 6. Through a terminal 32, the automobile's travel direction information detected by the gyro 6*b* is inputted in the interface. The received data supplied from the GPS antenna 5 and the car speed pulse and travel direction information as the travel information supplied from the autonomous navigation unit 6 are transferred to the positioning section 4 via a bus 20. By use of the transferred information as parameters, the positioning section 4 determines the automobile's current location. The road traffic information supplied from the traffic information antenna 7 is written by the controller 19 to the DRAM 13. The controller 19 references this road traffic information stored in the DRAM 13 to control the image processing such that the road traffic information such as a congestion status is reflected onto the map information image data to be displayed on the display monitor 3, for example.

A clock 15 clocks the current time. The obtained time information is used by the navigator system 1 for the time management therein. It should be noted that the time of the clock 15 may be calibrated with reference to the time information supplied from the GPS satellite to minimize clocking error.

An input section 16, connected to the receiver 3*b* of the display monitor 3, receives a command signal supplied from the remote controller 8. The input section 16 converts the received command signal into a format which can be transmitted over the internal bus 20 and transmits the converted signal to the controller 19. The controller 19 executes required control processing as instructed by the received command.

A display driver 17 generates the image information to be displayed under the control of the controller 19 and outputs the generated image information to the display screen section 3*a* of the display monitor 3 via a terminal 34. For example, on the basis of the map information read from the recording medium 9 and the automobile's current location information computed by the positioning section 4, the display driver 17 generates an image signal indicative of the automobile's current location and outputs the generated image signal to the display monitor 3. An audio output processor 49 performs predetermined audio signal generation processing and audio signal processing if an audio message is to be outputted and outputs the generated audio message to a speaker SP as an amplified analog audio signal.

The disk driver 18 reproduces the data stored in the recording medium 9. Actually, the disk driver 18 has the reproducing capabilities compatible with the medium format of a recording medium to be reproduced by the disk driver 18. For example, the map information reproduced from the recording medium 9 is transferred to the DRAM 13 via the bus 20 to be referenced by the controller 19 for use as display data in a predetermined timed relation.

An audio/visual (A/V) processor 46 perform predetermined digital signal processing on the inputted image signal and audio signal, finally converting the processed signals into data having a format which can be recorded to the storage section 45. The image signals to be inputted in the A/V processor 46 are those supplied from the in-car camera 3*c*, the front camera 3*d*, and the external camera 42. The A/V processors 46 first converts these signals into digital signals and then converts each of the digital signals into compressed moving image data having a predetermined format by time-division processing. The audio signal to be inputted in the A/V processor 46 is supplied from the microphone 43. The A/V processor 46 first converts the inputted audio signal into digital data and then converts the digital data into compressed audio signal data having a predetermined format. These compressed moving image data and audio data are written by the controller 19 to the storage section 45 via the internal data bus 20.

If the storage section 45 overflows with the moving image and the audio data being written thereto, the least recently written data are written over with the most recent data. This arrangement can save the storage capacity of the storage section 45. Generally, a storage capacity equivalent to about 10 minutes is enough for the purpose of retaining the evidence for one case of incident.

The A/V processor 46 may have a decoding capability of reproducing the audio/visual data stored in the storage section 45 for example. The decoding capability can reproduce the audio/visual data stored in the storage section 45 and display the reproduced data on the display monitor 3 for example.

A communication interface 47 transfers/receives data between the communication terminal unit 50 and the navigator main frame 2. For example, when data is outputted from the communication terminal unit 50 to the navigator main frame 2, the communication interface 47 converts the data inputted from the communication terminal unit 50 into a format which can be processed in the navigator main frame 2 and outputs the converted data to a predetermined functional circuit via the internal data bus 20. Conversely, when transferring data from the navigator main frame 2 to the communication terminal unit 50, the communication interface 47 converts the data into a format which can be processed in the communication terminal unit 50 and outputs the converted data thereto.

In the above-mentioned operation, the communication terminal unit 50 is controlled by the controller 19 of the navigator main frame 2. Namely, the cooperatively wireless communication between the communication terminal unit 50 and the navigator main frame 2 provides the navigator system 1 of the present embodiment with a communication capability of communicating with the Internet for example.

The controller 19 is constituted by a CPU (Central Processing Unit) for example to execute predetermined control operations on the other components of the navigator system.

Figure 4:
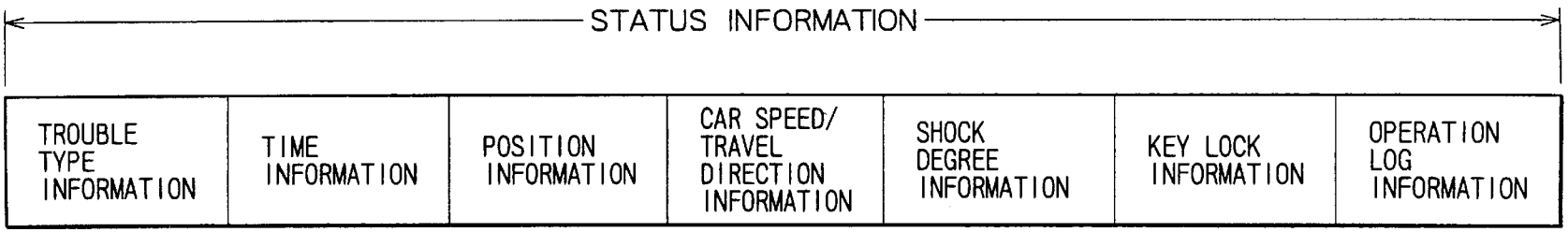
FIG. 4 illustrates an exemplary structure of status information.

Referring to FIG. 4, there is shown a schematic structure of status information which is generated in the navigator system 1 and stored in the memory 12 for example. As shown, the status information consists of trouble type information, time information, positional information, car speed/travel direction information, shock degree information, key lock information, and operation log information. The trouble type information indicates a type of trouble into which the user in the automobile has run; for example, traffic accident, a trouble with a person outside the automobile, or automobile malfunction. The time information can be obtained from the time information clocked by the clock 15. The positional information can be obtained from the current positional information determined by the positioning section 4. The car speed/travel direction information can be obtained from the car speed detected by the car speed sensor 6*a* of the autonomous navigation unit 6 and the directional information based on the angular velocity detected by the gyro 6*b*. The shock degree information can be obtained from the information supplied by the shock sensor 48. The key lock information can be obtained from a key lock status in the lock controller 44. The operation log information indicates the operation log recorded in a predetermined time or in a predetermined operation count which can be obtained on the basis of the operation commands inputted by the remote controller 8 for example. The above-mentioned items of information are obtained by the controller 19 and generated as the status information. If necessary, the status information generated on the basis of the these items of information obtained at a certain point of time can be stored in the memory 12. It should be noted that the contents of the status information are not limited to those mentioned above. Other items of information may be included in the status information if they can be obtained by the navigation system 1. If any of these items of status information is determined unnecessary depending on the contents of actual services, the unnecessary items may be deleted from the status information.

1-4 Internal Configuration of the Application Server

Figure 5:
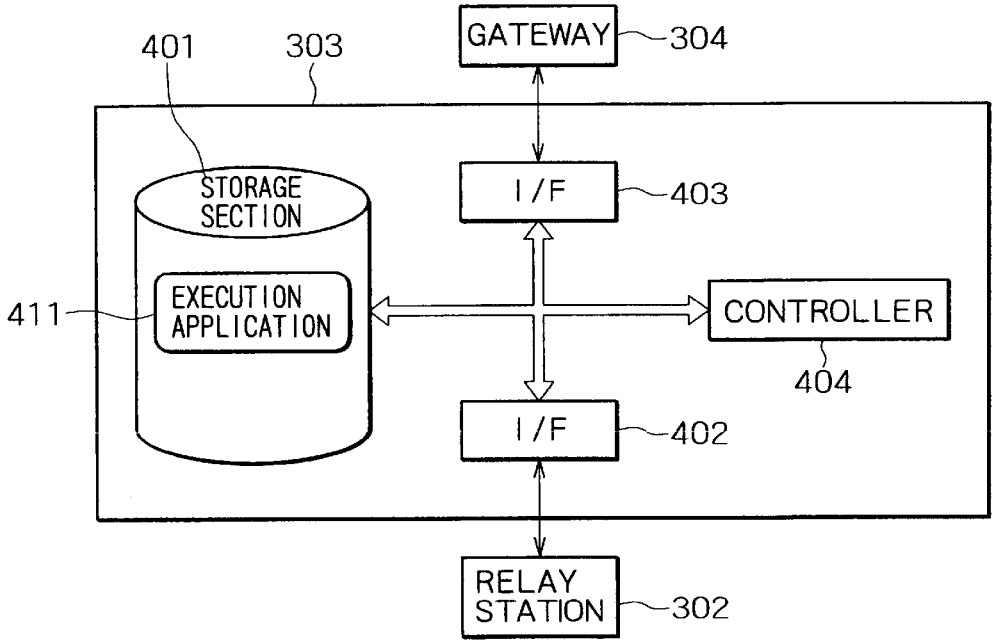
FIG. 5 is a block diagram illustrating an exemplary internal configuration of an application server of FIG. 1.

Referring to FIG. 5, there is shown an exemplary internal configuration of the application server 303 arranged in the wireless telephone communication network 300. The application server 303 has a storage section 401, interfaces 402 and 403, and a controller 404 for example as shown. The storage section 401 stores various items of information necessary for realizing the capabilities as the application server. In this example, an execution application 411 is shown as typical data stored in the storage section 401. The controller 404 executes processing as instructed by the execution application 411 to make communication between the transfer/reception formats in the wireless telephone communication network 300 and in the Internet 400, thereby enabling the data communication with the Internet via the wireless telephone communication network 300. This also realizes a mail transfer/reception capability of a mobile telephone via the Internet.

The interface 402 transfers/receives information with the relay station 302. The interface 403 transfers/receives information with the gateway 304 connected to the Internet. The controller 404 executes various control operations as instructed by the execution application 411.

1-5 Internal Configuration of the Service Server

Figures 6A, 6B:
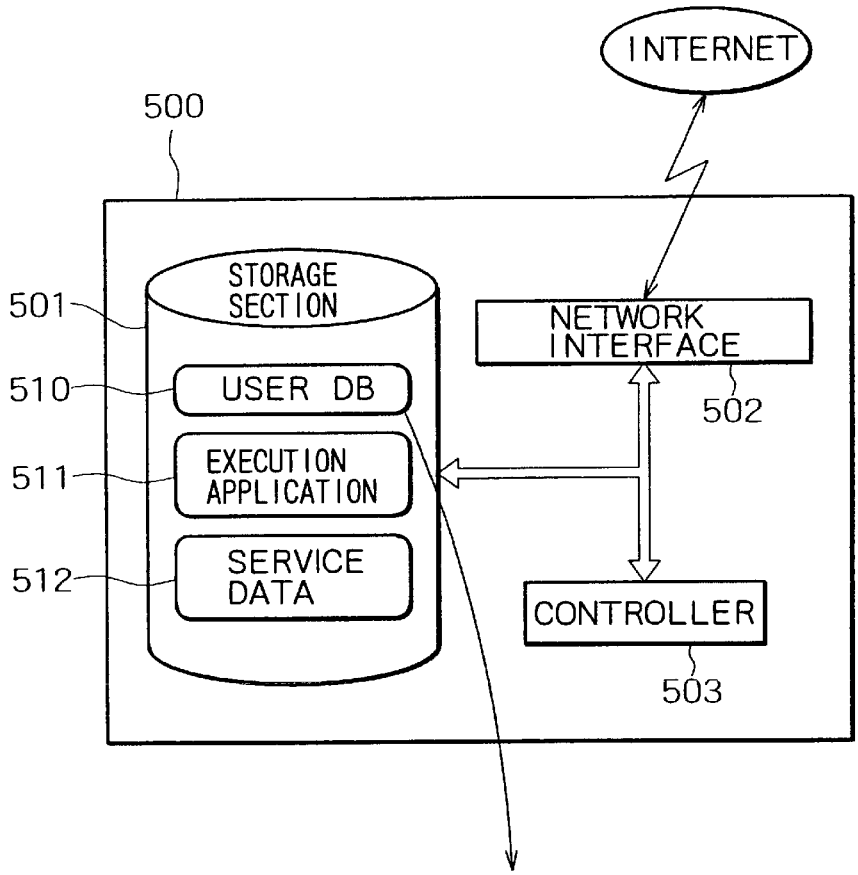
FIG. 6A is a block diagram illustrating an exemplary configuration of a service server of FIG. 1.
FIG. 6B illustrates an exemplary structure of a user database stored in the service server of FIG. 6A.

Referring to FIG. 6A, there is shown an exemplary internal configuration of the service server 500. As shown, the service server 500 has a storage section 501, a network interface 502, and a controller 503. In this example, the storage section 501 also stores various items of information necessary for realizing the service server capabilities. In this example, a user database 510, an execution application 511, and a service data 512 are shown as typical data stored in the storage section 501.

Referring to FIG. 6B, the user database 510 stores the user information and navigator ID for the user of the navigator system 1. The user information includes user's name and address, birthday, the type of automobile on which the navigator system 1 is installed, namely the type of the automobile covered by the insurance, and other information necessary for the provision of security services. The navigator ID is the same as that allocated to the navigator system 1. The navigator ID may be a telephone number allocated to the wireless terminal unit 50 for example. In this case, the application server 303 or the service server 500 can easily access the wireless terminal unit of the navigator system 1.

In the user database 510 shown in FIGS. 6A and 6B, the information about each user may be prepared by acquiring predetermined information at the following occasions for example. In the present embodiment, the navigator system 1 can be purchased in combination with an automobile insurance by so-called Internet shopping. To purchase the navigator system 1 in Internet shopping, the user enters his personal information in an input form displayed on a browser screen for example. In the case of the navigator system 1 having the wireless terminal unit 50 in the present embodiment, the user also signs a contract with a telecommunication carrier to make the wireless terminal apparatus 50 usable. In the present embodiment, the service server 500 communicates with a sales server for Internet shopping to receive the inputted personal information and stores it as a database. Namely, the user database 510 is automatically generated when the user purchases an automobile insurance product and the navigator system 1 by Internet shopping. The execution application in this example includes various application programs corresponding to various processes to be executed by the service server 500. The service data 512 stores various service data to be transmitted to the navigator system 1 or communication terminals such as mobile telephones, for example. The network interface 502 connects the service server 500 to the Internet. The controller 503 executes various control operations as instructed by the execution application 411.

2. Exemplary Service Provision by the Security System

The following describes some forms of security services which can be realized by the security system having the above-mentioned configuration. It is assumed here that the user gets in a traffic accident while driving the automobile 100, for example. The controller 19 of the navigator system 1 determines whether the degree of the shock sensed by the shock sensor 48 is over a predetermined level indicative of a traffic accident. If the shock is found over the predetermined level, then the automobile 100 is determined to have been involved in a traffic accident. Alternatively, a traffic accident may be determined by the user's operating the emergency key 8*a*. Alternatively still, if the image supplied from the external camera 42 shows an automobile which is quickly approaching toward the automobile 100, the degree of shock may be estimated from the measured approaching speed of the approaching automobile, thereby forecasting a traffic accident. Anyhow, if a traffic accident is found happened, then the controller 19 of the navigator system 1 gathers various items of information obtained at the occurrence of the traffic accident and stores the gathered information in the memory 12. In this example, the traffic accident status information includes trouble type information, time information, positional information, car speed/travel directional information, shock degree information, key lock information, and operation log information. Then, the navigator system 1 accesses the service server 500 through the communication terminal unit 50, the wireless telephone communication network 300, and the Internet. When the access has been made successfully, the controller 19 transmits the status information from the memory 12.

In the navigator system 1 of the present embodiment, the images taken by the in-car camera 3*c*, the front camera 3*d*, and the external camera 42 are related to the audio signal supplied by the microphone 43 in a time-dependent manner to be continuously stored in the storage section 45. If a traffic accident is found encountered as described above, the controller 19 sends the image and audio data taken during a certain period before and after the traffic accident to the service server 500 in the same manner as the status information.

Receiving these status information and image/audio data, the managing side of the service server 500 handles them as an accident report to the automobile insurance company. Subsequently, the managing side takes a procedure for the post processing corresponding to the traffic accident for example. If the managing side determines that wrecking services for example are necessary from the received status information and image/audio data, the managing side may dispatch the road services to the site of the traffic accident. In this case, the location of the accident site can be determined from the positional information included in the status information. The managing side of the service server 500 may also notify the police of the accident and request for emergency vehicles if necessary. It should be noted that the received status information and image/audio data provide the evidence for use in out-of-court settlement by the automobile insurance company for example, so that they are stored in the service server 500 for example.

If the user gets into troubles during driving, such as running out of gas, having a flat tire, engine failure, engine overheat, or tire run-off for example, the user can perform a predetermined operation on the navigator system 1 to request the service server 500 for road services. Namely, the user can request for road services by the operation on the navigator system 1 without making a telephone call to the managing side of the service server 500. The type of trouble is also automatically transmitted to the service server 500, so that the managing side can dispatch appropriate road services.

When dispatching a road service vehicle to the accident site, communication is made between the service server 500 and the road service vehicle to always keep track of the road service vehicle. The service server 500 can access the navigator system 1 to notify the same of the location of the road service vehicle. Receiving the road service vehicle positional information, the navigator system 1 displays a map around the accident site under the control of the controller 19 to display both the location of the automobile 100 and the location of the road service vehicle, thereby mitigating the user frustration in waiting for rescue. In addition to the displaying of these locations, it is also practical to estimate on the side of the service server 500 a time which takes for the road service vehicle to reach the accident site and send the estimated time to the navigator system 1. The navigator system 1 can display or sound the received rescue arrival time.

Sometimes, the user may be involved during driving in a trouble with a person who threatens the user inside the automobile 100 for example. If such a situation occurs and the user feels that his safety is threatened, the user operates the emergency key 8*a*.

Upon the operation of the emergency key 8*a*, the navigator system 1 sends the status information at this moment and the image/audio data taken upon the operation of the emergency key 8 to the service server 500. The image/audio data have an image of the threatening person and a voice uttered by him. These image/audio data are available as the evidence to be used later for example. On the basis of the received status information and image/audio data, the managing side of the service server 500 takes actions for preventing the current trouble from worsening. For example, the service server 500 sends the information which instructs the user to take actions necessary for escaping from the current situation. The received information is displayed or sounded on the navigator system 1. If necessary, the service server 500 notifies the police of the situation and requests it to go into action. Because the service server 500 is always receiving the site positional information included in the status information, the service server 500 can correctly notify the police of the location of the site.

Currently, the data transfer rate in the connection to the Internet 400 via the wireless telephone communication network 300 is restricted to a certain level. Consequently, the transfer/reception of the image/audio data, especially the image data, via the wireless telephone communication network 300 and the Internet 400 takes considerable time. Depending on the seriousness of the trouble in which the user is involved, the service server 500 may initially require only the status information, not the image/audio data. In such a case, the image/audio data may be transferred later. Therefore, in the present embodiment, when transmitting the status information and the image/audio data in response to an emergency situation, the navigator system 1 transmits the status information first. Based on the received status information, the service server 500 determines the seriousness of the trouble in which the user has been put. For example, in the case of a traffic accident, the service server 500 can estimate the seriousness from the degree of shock indicated by the shock degree information included in the status information. The service server 500 can also recognize whether the automobile 100 is on an open road or an express highway from the positional information. These road situations also contribute to the determination of the seriousness. If the seriousness is found higher than the predetermined level, the service server 500 requests the navigator system 1 to supply the image/audio data. In response, the navigator system 1 transmits the image/audio data taken at the occurrence of the trouble from the storage section 45 to the service server 500. Thus, the present invention provides efficient and appropriate security services despite the current restrictions in Internet communication speeds.

3. Processing Operations

Figure 7A:
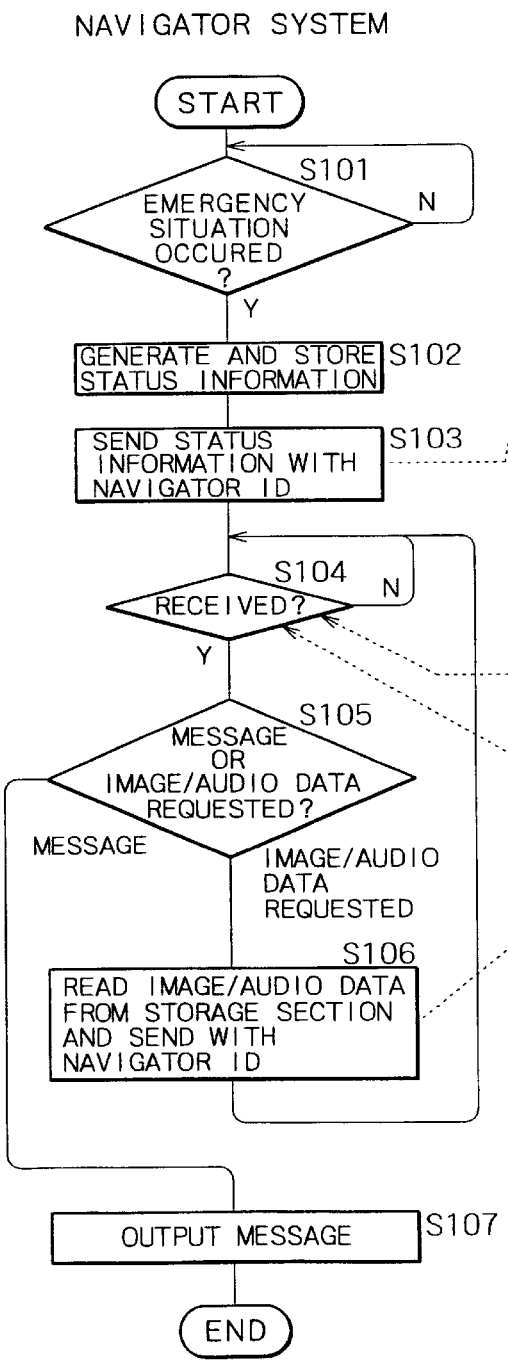
FIG. 7A is a flowchart describing the processing operations of the navigator system for realizing the security services of the embodiment.
Figure 7B:
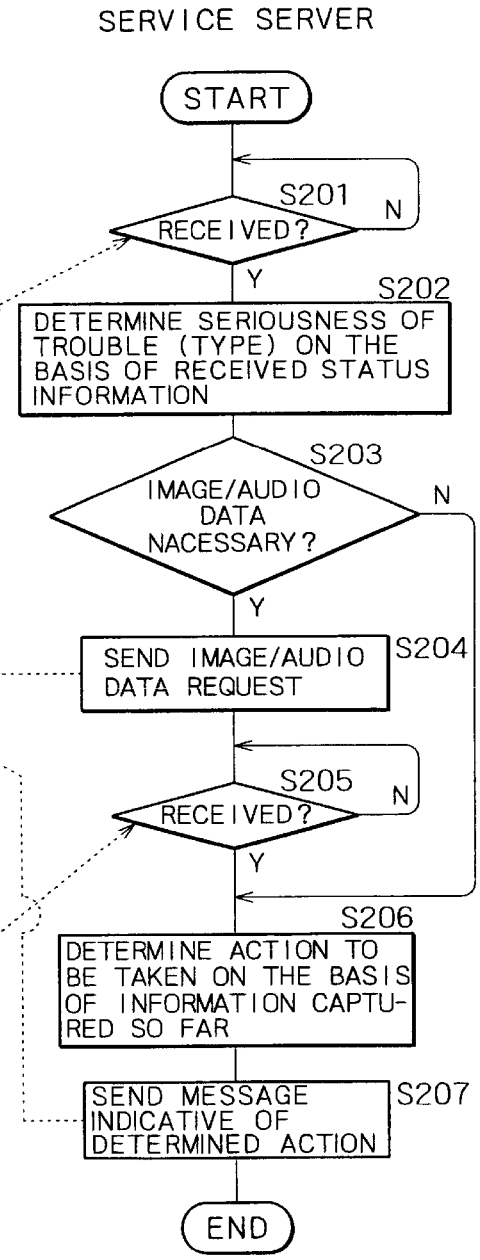
FIG. 7B is a flowchart describing processing operations of the service server for realizing the security services of the embodiment.

The following describes the processing operations to be carried out between the navigator system 1 and the service server 500 to realize the above-mentioned security services with reference to the flowcharts shown in FIGS. 7A and 7B. It should be noted that the processing operations in the navigator system 1 are executed by the controller 19 and those in the service server 500 are executed by the controller 503. Although not shown, every time communication is made between the navigator system 1 and the service server 500, the application server 303 converts the communication format for the wireless telephone communication network 300 into the communication format for the Internet 400 for example for data transfer and vice versa.

First, in the navigator system 1, the controller 19 determines whether an emergency situation such as a trouble with passerby or a traffic accident has occurred or not in step S101. If an emergency situation is found occurring on the basis of the shock degree sensed by the shock sensor 48 or the operation of the emergency key 8*a*, the procedure goes to step S102.

In step S102, the controller 19 gathers the various items of information shown in FIG. 4 obtained at the occurrence of the trouble to generate status information and stores the generated status information into the memory 12. In step S103, the controller 19 sends the status information along with the navigator ID of the navigator system 1.

The navigator ID and the status information transmitted in step S103 are received by the service server 500 via the wireless telephone communication network 300 and the Internet 400 as a process by the application server 303. When the reception of the navigator ID and the status information is recognized by the service server 500 in step S201, the procedure goes to step S202. In step S202, the controller 503 determines the seriousness of the trouble on the basis of the received status information. In step S203, the controller 503 determines in the service server 500 whether the image/audio data are necessary for detailed situation analysis. This determination may be made by obtaining the seriousness of the trouble in numeric value and determining whether the obtained numeric value is higher than a predetermined level. In step S202, if the trouble type information included in the received status information indicates a high degree of seriousness for example, the controller 503 determines that the image/audio data are necessary. This indicates, for example, that the user is involved in a trouble with a passerby. In such a situation, the image/audio data are required as quickly as possible.

If, in step S203, the image/audio data are found unnecessary, the procedure goes to step S206; if the image/audio data are found necessary, the procedure goes to step S204. In step S204, the controller 503 sends an image/audio data request to the navigator system 1. In this operation, the service server 500 specifies the navigator ID received in step S201 as the destination and sends the image/audio data request to the wireless telephone communication network 300 via the Internet. the application server 303 in the wireless telephone communication network 300 specifies, from the navigator ID, the telephone number as the access destination and wirelessly transfers the image/audio data request via the relay station 302 and the base station 301.

After sending the status information in step S103, the navigator system 1 waits for the data from the service server 500 to be received in step S104. When the data supplied from the service server 500 through the wireless telephone communication network 300 arrives at the communication terminal unit 50 and is captured in the navigator main frame 2 and the reception of the data is discriminated, the procedure goes to step S105.

In step S105, the controller 19 determines whether the data received in step S104 is a message or an image/audio data request. The message is data sent from the service server 500, which will be described later. If the received data is found an image/audio data request in step S105, the procedure goes to step S106. In step S106, the controller 19 reads from the storage section 45 the image/audio data equivalent to about several tens of seconds for example taken at the occurrence of the emergency situation determined in step S101 and sends the read image/audio data with the navigator ID. After the process of step S106, the procedure returns to step S104 to wait for a message to be received subsequently.

On the service server 500, after sending the image/audio data request in step S204, the controller 503 waits for the image/audio data to be received from the navigator system 1. When the image/audio data has been received, the procedure goes to step S206.

In step S206, the controller 503 determines the action to be taken against the trouble on the basis of the information received by the navigator system 1. If the procedure has proceeded from step S203 to step S206, the controller 503 determines the action to be taken only on the basis of the status information. If the procedure has proceeded from S204 to S205 to S206, then the controller 503 determines the action to be taken on the basis of both the status information and the image/audio data. This decision making may be made by the controller 19 as instructed by the execution program for decision making for example. Namely, the controller 19 selects the message data corresponding to the actions to be taken prepared in accordance with trouble types and seriousness degrees obtained by analysis of the status information and the image/audio data. Alternatively, the management personnel of the service server 500 may checks the status information and the image/audio data and operates the server accordingly to provide appropriate actions to be taken.

When the action to be taken has been determined by any of the above-mentioned methods, the procedure goes to step S207, in which the message indicative of the determined action is sent to the navigator system 1. In this operation, the navigator ID received in step S205 or S201 is specified as the destination to send the message.

In the navigator system 1, when this message has been received, the decision is yes in step S104 and the procedure goes to step S105. In this case, however, the received data is found a message in step S105 and the procedure goes to step S107. In step S107, the received message is displayed or sounded. For example, the user looks at the message on the display screen section 3*a* or listen to the message sounded from the speaker SP to take appropriate actions.

It will be apparent to those skilled in the art that the present invention is not restricted to the above-mentioned embodiment. For example, in the above-mentioned embodiment, an insurance company provides the automobile-associated security services by use of the navigator system 1 which was purchased in combination with automobile insurance. The form of security service provision is not restricted to this combination purchase. Various other forms of security services than that mentioned above are possible. The configuration of communication between the mobile terminal side and the server side by use of a wireless telephone communication network and the Internet is not restricted to the configuration illustrated in the above-mentioned embodiment.

As described and according to the invention, a security system is built in which a navigator system connected to a security unit for gathering information from the operating means and various kinds of sensors installed on a movable body such as an automobile, manipulating the gathered information, and storing the manipulated information is connected to a service server called a security server via a wireless telephone communication network and the Internet for example. If the user in a movable body is found in an emergency situation detected by the sensors or the operating means, the security unit sends the status information obtained from the sensors for sensing emergency status and the image/audio data taken by the sensors for sensing various situations around the movable body to the server. Based on the received status information and image/audio data, the server takes necessary security actions.

Consequently, if the client in an automobile is involved in a traffic accident or any other troubles for example, the security unit notifies the server thereof quickly and correctly as well as the circumstances thereof. On the basis of this notification, the server manager takes appropriate actions. Thus, the present invention expands movable body associated security services as after-sale service as compared with conventionally practiced counterpart. For example, building the above-mentioned system jointly by an automobile insurance company and a car navigator maker in selling a combination of an automobile insurance policy, an intangible product, and a car navigator, a tangible product, can expand the various services for automobile insurance clients, enhancing the added values of these products, which brings significant advantages to both the purchaser and the seller.

As described and according to the invention, when the security unit sends the status information and the image/audio data to the security server, the security unit first sends the status information whose data amount is small. On the basis of the received status information, the security server determined whether or not the image/audio data whose amount is large are necessary. If the image/audio data are found necessary, the security server requests the security unit for them. Thus, the image/audio data are transmitted only when necessary, thereby allowing the security system to be efficiently managed in a communication environment in which the data transfer rate is not enough for transferring a large mount of data at once.

While the preferred embodiments of the present invention have been described using specific terms, such description is for illustrative purposes only, and it is to be understood that changes and variations may be made without departing from the spirit or scope of the appended claims.

What is claimed is:

1. A status notification system for automatically wirelessly communicating status information supplied from a plurality of sensors installed on said movable body, comprising:

a status sensing unit for transmitting predetermined data to said response unit through said communication unit when said movable body has a predetermined status based upon data obtained from said plurality of sensors and for selectively transmitting said data obtained from said plurality of sensors when an additional information transmission request is received from said response unit through said communication unit;

a response unit;

a communication unit for wirelessly communicating with said status sensing unit and for communicating with said response unit, wherein said response unit receives said predetermined data from said status sensing unit through said communication unit, determines whether an acquisition of said additional information is necessary based upon said predetermined data, and requests said transmission of said additional information from said status sensing unit when said acquisition of said additional information is necessary;

said status sensing unit having:

input means for inputting sensing information sensed from said plurality of sensors;

storage means for storing said sensing information inputted by said input means;

sensing means for sensing whether said sensing information is within a predetermined range;

first communication means for wirelessly communicating with said response unit; and first control means for selecting predetermined sensing information from said sensing information stored in said storage means when said movable body having said sensing unit is in said predetermined status, for controlling said first communication means to wirelessly transmit said selected sensing information to said response unit, and for reading said requested additional information from said storage means to transmit said read additional information when said acquisition request is received from said response unit;

said communication unit having:

wireless communication means for wirelessly communicating with said status sensing unit;

network communication means for communicating with said response unit connected to said network; and conversion means for converting a data format of said wireless communication and a data format of said network communication; and said response unit having:

second communication means for communicating with said status sensing unit through said network;

evaluation means for evaluating said status of said movable body having said status sensing unit from said predetermined sensing information supplied from said status sensing unit; and second control means for controlling said second communication means to transmit acquisition request information for requesting said additional information to said status sensing unit when said additional information request is necessary based upon an evaluation result from said evaluation means.

2. The status notification system according to claim 1, wherein said sensing information inputted from said plurality of sensors into said status sensing unit is positional information about said movable body.

3. The status notification system according to claim 1, wherein said sensing information inputted from said plurality of sensors into said status sensing unit is a result of sensing an acceleration applied to said movable body.

4. The status notification system according to claim 1, wherein said sensing information inputted from said plurality of sensors into said status sensing unit is a result of sensing a speed of said movable body.

5. The status notification system according to claim 1, wherein said sensing information inputted from said plurality of sensors into said status sensing unit is one of internal images and external images of said movable body.

6. The status notification system according to claim 5, wherein said additional information is one of said internal images and said external images.

7. The status notification system according to claim 1, wherein said sensing information inputted from said plurality of sensors into said status sensing unit is one of internal audio information and external audio information of said movable body.

8. The status notification system according to claim 7, wherein said additional information is one of said internal audio information and said external audio information.

9. A status notification apparatus for automatically wirelessly communicating a status of a movable body to a response unit connected to a network through a commutation unit, comprising:

input means for inputting a plurality of pieces of sensing information sensed from a plurality of sensors;

storage means for storing said plurality of pieces of sensing information inputted by said input means;

sensing means for sensing whether said plurality of pieces of sensing information is within a predetermined range;

communication means for wirelessly communicating with said communication unit; and control means for selecting predetermined sensing information from said plurality of pieces of sensing information inputted from said plurality of sensors when said plurality of pieces of sensing information is within said predetermined range, for controlling said communication means to transmit said selected sensing information to said response unit as initial information through a communication unit, and for controlling said communication means to selectively read requested sensing information from said storage means and to transmit said read sensing information to said response unit when an additional information request signal is received from said response unit.

10. The status notification apparatus according to claim 9, wherein said sensing information inputted from said plurality of sensors into said status sensing unit is positional information about said movable body.

11. The status notification apparatus according to claim 9, wherein said sensing information inputted from said plurality of sensors into said status sensing unit is a result of sensing an acceleration applied to said movable body.

12. The status notification apparatus according to claim 11, wherein said sensing information sensed by said sensing means is a result of sensing an acceleration applied to said movable body.

13. The status notification apparatus according to claim 12, wherein said status corresponding to said acceleration is a collision of said movable body.

14. The status notification apparatus according to claim 9, wherein said sensing information inputted from said plurality of sensors into said status sensing unit is a result of sensing a speed of said movable body.

15. The status notification apparatus according to claim 9, wherein said sensing information inputted from said plurality of sensors into said status sensing unit is one of internal images and external images of said movable body.

16. The status notification apparatus according to claim 15, wherein said additional information is one of said internal images and said external images.

17. The status notification apparatus according to claim 9, wherein said sensing information inputted from said plurality of sensors into said status sensing unit is one of internal audio information and external audio information of said movable body.

18. The status notification apparatus according to claim 17, wherein said additional information is one of said internal audio information and said external audio information.

19. The status notification apparatus according to claim 9, wherein said status notification system further comprises map reproduction means for reproducing map information and image display means for displaying said reproduced map information.

20. The status notification apparatus according to claim 19, wherein said map information includes a current location of said movable body.

21. The status notification apparatus according to claim 20, wherein information representing a current location of another movable body moving relative to said movable body is displayed on said image display means when said predetermined sensing information is transmitted to said response unit.

22. The status notification apparatus according to claim 21, wherein said information representing paid current location of said another movable body is received by said communication means.

23. The status notification apparatus according to claim 9, further comprising:

operation means operated by a user of said status notification apparatus, wherein said control means transmits said sensing information to said response unit when said operation means is operated by said user.

24. A response apparatus for communicating via a network with a status notification apparatus which selectively transmits information supplied from a plurality of sensors installed on a movable body by wirelessly communicating with a communication unit, comprising:

communication means for network-communicating with said communication unit;

evaluation means for evaluating predetermined sensing data selectively supplied from said status notification apparatus; and control means for controlling said communication means to transmit an additional information transmission request signal requesting a transmission of additional sensor information to said status notification apparatus when a reception of further sensor information from said status notification apparatus is necessary based upon a result of an evaluation performed by said evaluating means, wherein said additional information includes image/audio data provided by said sensors installed on said movable body.

25. The response apparatus according to claim 24, further comprising:

storage means for storing said additional sensor information supplied from said status notification apparatus in response to said additional information transmission request signal.

26. The response apparatus according to claim 24, wherein when an evaluation result of said sensor information supplied from said status notification apparatus is within a predetermined range said response apparatus issues a command for moving another movable body to a current location of said movable body having said status notification apparatus.

27. The response apparatus according to claim 24, wherein when an evaluation result of said sensor information supplied from said status notification apparatus is within a predetermined range said response apparatus selectively transmits said sensor information supplied from said status notification apparatus to another unit.

28. The response apparatus according to claim 27, wherein said another unit to which said sensor information is transmitted is a rescue request acceptance unit controlled by police.

29. The response apparatus according to claim 27, wherein said another unit to which said sensor information is transmitted is a receiver installed at an insurance company which manages an insurance policy covering said movable body.

30. The response apparatus according to claim 24, wherein said sensor information requested by said additional information transmission request signal is image information.

31. The response apparatus according to claim 24, wherein said sensor information requested by said additional information transmission request signal is audio information.

* * * * *